US005254813A

United States Patent [19]

Hirashiki

[11] Patent Number: 5,254,813

[45] Date of Patent: Oct. 19, 1993

[54] ELEVATOR CONTROLLING AND MONITORING SYSTEM

[75] Inventor: Yasuhiro Hirashiki, Tokyo, Japan

[73] Assignee: Kabushiki Kaisha Toshiba, Kawasaki, Japan

[21] Appl. No.: 737,132

[22] Filed: Jul. 29, 1991

[51] Int. Cl.[5] ..... B66B 3/00

[52] U.S. Cl. ..... 187/130; 187/133; 187/101

[58] Field of Search ..... 187/133, 130, 101; 369/900

[56] References Cited

U.S. PATENT DOCUMENTS

| | | | |
|---|---|---|---|
| 4,542,479 | 9/1985 | Kamimura et al. | 364/900 |
| 4,568,909 | 2/1986 | Whynacht | 187/133 |
| 4,930,604 | 6/1990 | Schienda et al. | 187/133 |

*Primary Examiner*—Steven L. Stephan
*Assistant Examiner*—Robert Nappi
*Attorney, Agent, or Firm*—Oblon, Spivak, McClelland, Maier & Neustadt

[57] ABSTRACT

In an elevator controlling system, there are provided: a plurality of controlling microcomputers for controlling a plurality of elevators; a console unit for entering at least command data and for monitoring conditions of the elevators under control; a single data transmission interface unit, one terminal of which is connected to the console means and the other terminal of which is commonly connected to these controlling microcomputers; and, a command data selecting unit interposed between the data transmission interface unit and these plural microcomputers, for selecting one of these plural microcomputers so as to receive the command data derived from the console unit via the transmission interface unit such that while the console unit is being connected via the command data selecting unit with one pair of the console unit and one selected controlling microcomputer, data communication is available between the console unit and other controlling microcomputer to monitor the condition of the elevator controlled by the last-mentioned microcomputer.

9 Claims, 10 Drawing Sheets

TRANSMISSION INTERRUPT PROCESS

ELEVATOR CONTROLLING AND MONITORING SYSTEM

BACKGROUND OF THE INVENTION

1. Field of the Invention

The present invention generally relates to an elevator controlling system. More specifically, the present invention is directed to an elevator controlling system for controlling elevators by employing a plurality of microcomputers (referred to as "controlling microcomputers) and also for communicating data among a console having a keyboard for entering the data and a display for displaying the data, and also the microcomputers in order to monitor control conditions.

2. Description of the Prior Art

Very recently, in elevator control apparatuses, most of sequence controls for the elevators have been performed under control of microcomputers. Also, motors functioning as power sources for the elevators have been controlled in a digital control manner, and therefore may be controlled by way of microcomputers.

Then, when all of the control operations required in the elevator systems have been executed under control of the controlling microcomputers, it is practically difficult to externally monitor the control conditions of the elevator. Then, to solve such a difficulty, the consoles have be utilized which include keyboards for entering data and displays for monitoring the data.

The consoles are connected to the controlling microcomputers via either the general-purpose transmission interface such as RS 232C, or the exclusively used interface, thereby operable as the terminals for the controlling microcomputers.

On the other hand, since a controlling microcomputer processes substantially all of the controls required for an elevator controlling system and therefore only one controlling microcomputer can hardly accept such a heavy load, a plurality of controlling microcomputers are prepared within a single elevator control apparatus.

Although either digital input/output apparatuses (DI/DO), or serial transmissions may be employed as the interfaces among plural controlling apparatuses, a parallel system bus, or a so-called "multi-bus" having higher data transmission speeds and higher expandabilities may be usually utilized.

In FIG. 1, there is shown an arrangement of a conventional elevator control system in which a plurality of controlling microcomputers are commonly connected to each other via a parallel system bus. That is, both one controlling microcomputer 1 and the other controlling microcomputer 2 commonly share the parallel system bus 3. Although not shown in detail, in the respective controlling microcomputers 1 and 2, a transmission interface unit 5, CPU (central processing unit) 12, ROM (read-only memory) 13, RAM (random access memory) 14, input/output devices (I/O) 15 and an interface unit 10 for the parallel system bus are commonly connected with each other by a local bus 9. In this figure, a console 4 is connected to the transmission interface unit 5, whereas the parallel system bus 3 is connected to the bus interface unit 10.

Since in this conventional elevator controlling apparatus with the above-described arrangement, there are provided the transmission interface units 5 within the respective controlling microcomputers 1 and 2, each of the controlling microcomputers 1, 2 per se can execute the processing operations required for monitoring the control conditions of the elevators. As a result, the console may merely function as a terminal unit with respect to the software for the monitoring purpose, so that various consoles may be utilized.

However, there is such a problem in the above-described elevator controlling apparatuses, that since the controlling microcomputers, for instance, 1 and 2 employ the transfer interface unit 5 respectively, when the maintenance or adjustment for the elevator is carried out while the console 4 is connected to one controlling microcomputer 1, and also the control states of the other controlling microcomputer 2 are wished to be monitored, an operator must disconnect this console 4 from the first controlling microcomputer 1 and then must connect it to the second controlling microcomputer 2, resulting in cumbersome maintenance work loads. Accordingly, easy and simple maintenance would be desired.

Furthermore, since the controlling microcomputers employing the own transmission interfaces having the same functions with each other, the more the number of controlling microcomputers is increased, the more a total quantity of such interfaces is similarly increased. This may cause costly elevator controlling apparatuses.

SUMMARY OF THE INVENTION

The present invention has been made in an attempt to solve the above-described problems, and therefore has an object to provide an elevator controlling system free from cumbersome maintenance work loads. Another object of the present invention is to provide an elevator controlling system manufactured in low cost.

These objects, other features and advantages of the present invention may be achieved by providing an elevator controlling system comprising:

a plurality of controlling microcomputers (100:200) for controlling a plurality of elevators;

console means (4) for entering at least command data (50) and for monitoring conditions of the elevators under control;

single data transmission interface means (5), one terminal of which is connected to the console means (4) and the other terminal of which is commonly connected to said plurality of controlling microcomputers (100:200); and, a plurality of transmission control changing means (26:46) for changing data communication established in each of pairs of the console means (4) and the respective controlling microcomputers (100:200) in response to the command data (50) entered by the console means (4) such that while the console means (4) is being connected with one pair of the console means (4) and one selected controlling microcomputer, data communication is available between the console means (4) and other controlling microcomputer to monitor the condition of the elevator controlled by the last-mentioned microcomputer.

Furthermore, an elevator controlling system, according to the present invention, comprises:

a plurality of controlling microcomputers (100:200) for controlling a plurality of elevators;

console means (4) for entering at least command data and for monitoring conditions of the elevators under control;

single data transmission interface means (5), one terminal of which is connected to the console means (4) and the other terminal of which is commonly connected to said plurality of controlling microcomputers (100:200); and, command data selecting means (60) interposed between the data transmission interface means (5) and said plural microcomputers (100:200), for selecting one of said plural microcomputers which receives the command data derived from the console means (4) via the transmission interface means (5) such that while the console means (4) is being connected via said command data selecting means (60) with one pair of the console means (4) and one selected controlling microcomputer, data communication is available between the console means (4) and other controlling microcomputer to monitor the condition of the elevator controlled by the last-mentioned microcomputer.

BRIEF DESCRIPTION OF THE DRAWINGS

For an better understanding of the present invention, reference is made of the following descriptions in conjunction with the drawings, in which.

DETAILED DESCRIPTION OF THE PREFERRED EMBODIMENTS

First Basic Idea

An elevator controlling system according to the present invention is constructed by mainly two basic ideas. Before processing with descriptions of various preferred embodiments according to the present invention, these basic ideas will now be summarized.

In an elevator controlling system according to the first basic idea, a console can transmit/receive data via a single transmission interface among all of controlling microcomputers, and an instruction for selecting which controlling microcomputer should be connected to this console, is issued by operating a keyboard of the console whereby the console delivers a series of instruction data to the selected controlling microcomputer which will then interpret this instruction command data series to judge whether or not the data transmission/reception are performed between this microcomputer and the console.

As a result of this first basic idea, even when the data transmission/reception are required for one controlling microcomputer while either maintenance or adjustment are carried out in another controlling microcomputer, the console can readily communicate with the former controlling microcomputer by merely issuing from the console such selection instruction data to the selected controlling microcomputer by simply operating the keyboard of this console.

Furthermore, in accordance with an elevator controlling system of a second basic idea (will be described more detail), a console can transmit/receive data via a single transmission interface among all of controlling microcomputers, and a selection is employed for selecting to which controlling microcomputer, data should be transmitted/received by the console.

Accordingly, even if the data transmission/reception are required for one controlling microcomputer while either maintenance or adjustments are carried out in another controlling microcomputer, the data communication between the console and the desired microcomputer can be readily established by simply manipulating the selection switch.

Arrangement of First Elevator Controlling System

Figure 1:
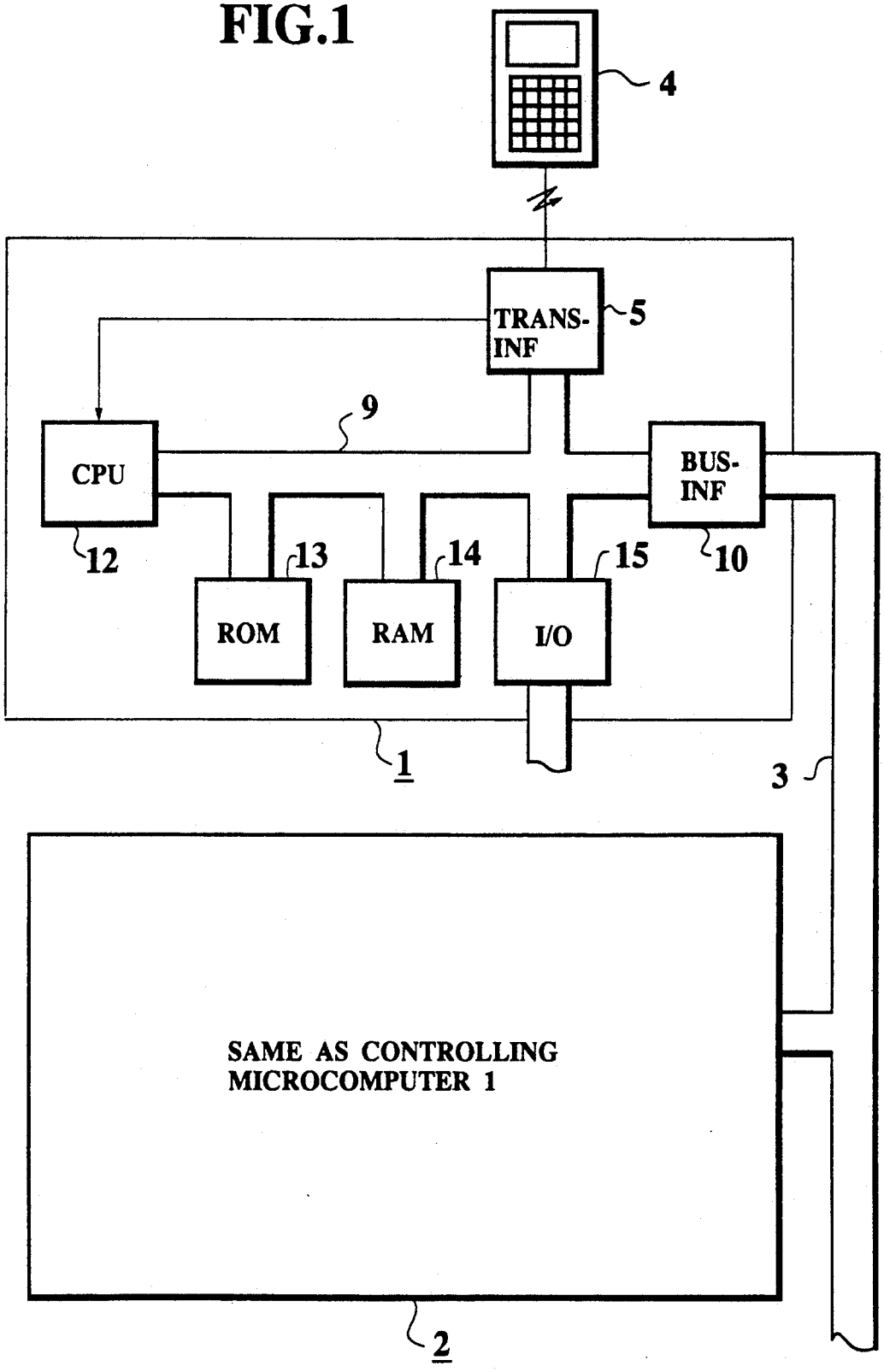
PRIOR ART FIG.1
FIG. 1 is a schematic block diagram for showing a conventional elevator controlling apparatus.
Figure 2:
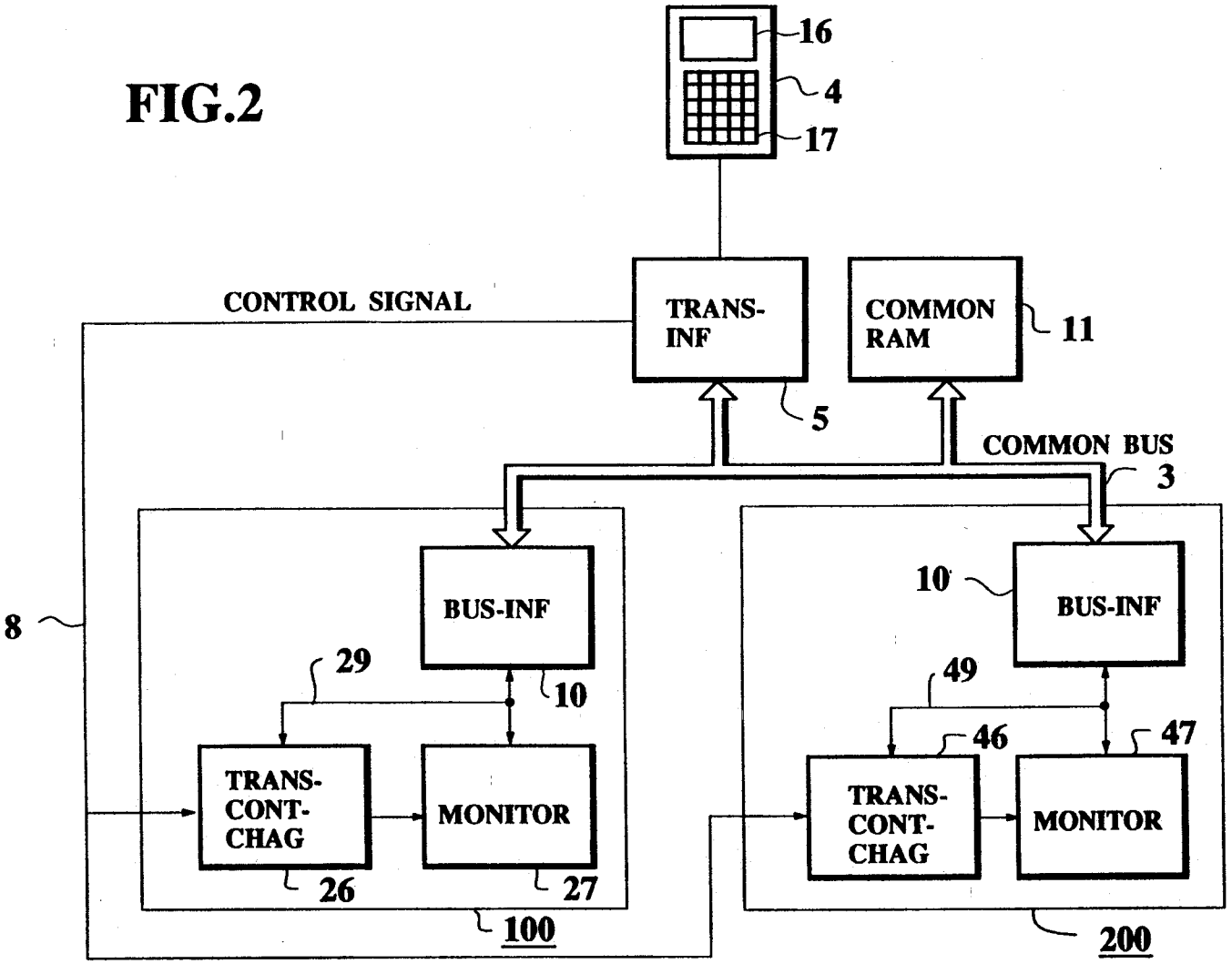
FIG. 2 is a schematic block diagram for representing an elevator controlling system arranged on the basis of a first basic idea of the present invention.

FIG. 2 represents an arrangement of an overall elevator controlling system according to a first preferred embodiment of the present invention, which is constructed on the above-described first basic idea.

In FIG. 2, this first elevator controlling system is mainly arranged by a first controlling microprocessor 100 and a second controlling microprocessor 200. The first controlling microprocessor 100 is connected via a common data bus 3 to the second controlling microcomputer 200. A data transmission interface unit 5 with respect to the console 4 is provided on this common bus 3. This data transmission interface unit 5 may be manufactured by employing, for instance, Intel's 8251 serial interface IC. A control signal derived from the transmission interface unit 5 is simultaneously supplied via another bus line 8 to the first and second controlling microcomputers 100 and 200, precisely speaking, via each of data transmission control changing units 26 and 46 to each of monitors 27 and 47. Local buses 29 and 49 are connected at the common bus interface units 10 with the common bus 3.

A common RAM (random access memory) 11 is employed on this common bus 3 in order to send/receive data between the first and second controlling microprocessors, 100 and 200. The first and second transmission control changing units 26 and 46 employed within the first and second controlling microcomputers 100 and 200 are operated in relation to the data stored in this common RAM 11.

It should be understood that the data transmission between the console 4 and either the first controlling microprocessor 100 or the second controlling microprocessor 200 must be performed by subdividing a series of data at a certain unit irrelevant to serial data or parallel data. Normally, this unit is selected to be 1 byte. It should be also noted that since the data transmissions or receptions in a single unit are continuously performed without any interruption, it is required to announce that either a reception demand in a single unit (namely, data in a single unit has been received from the console 4), or a transmission demand in a single unit (namely, data in a single unit has been sent to the console 4) to either the first controlling microcomputer 100, or the second controlling microcomputer 200. This announcement signal will be referred to a "transmission control signal".

The data transmission processing operation is carried out by either the first or second controlling microcomputers 100 or 200 in response to this transmission control signal. Both of the first and second controlling microcomputers 100 and 200 can write/read the data into/from the transmission interface unit 5. If the first transmission controlling unit 26 of the first controlling microcomputer 100 sends the transmission control signal to the monitor 27 thereof, but the second transmission controlling unit 46 of the second controlling microcomputer 200 does not send the transmission control signal to the monitor 47 thereof, only the first controlling microcomputer 100 performs the data transmission via the transmission interface unit 5 with this console 4. Conversely, only the second controlling microcomputer 200 performs such a data transmission via the transmission interface unit 5 with this console 4.

Internal Arrangement of First Elevator Controlling System

Figure 3:
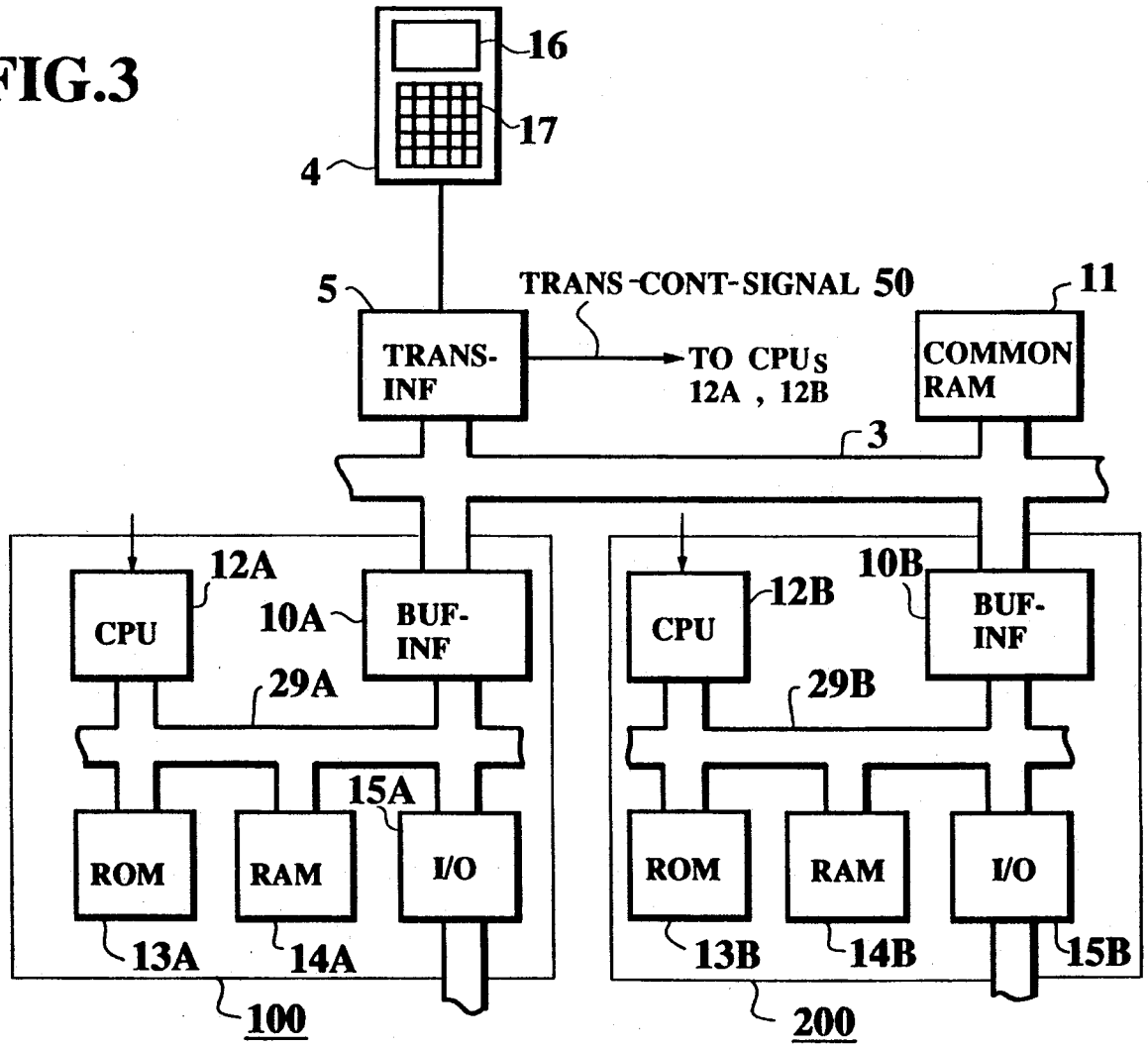
FIG. 3 is a schematic block diagram for showing an internal arrangement of the first system shown in FIG. 2.

FIG. 3 is a schematic block diagram for showing an internal arrangement of an elevator controlling system according to a first preferred embodiment of the present invention.

In the first preferred embodiment, the data transmission among the console 4, the first controlling microcomputer 100 and the second controlling microcomputer 200 is a serial data transmission. A transmission control signal (interrupt signal) 50 derived from the transmission interface unit 5 is produced by wired-ORing a reception demand and a transmission demand, and then supplied to the first and second controlling microcomputers 100 and 200 as an interrupt signal.

In the first controlling microcomputer 100, a first central processing unit (CPU) 12A, ROM (read-only memory) 13A, RAM (random access memory) 14A, an output device 15A and the like are mutually connected with each other by the local bus 29A. This local bus 29A is connected via the common bus interface unit 10A to the transmission interface unit 5. It should be noted that this common bus interface unit 10A corresponds to the bus interface unit 10 employed in the first controlling microcomputer 100 shown in FIG. 2. The functions of the first CPU 12A are to read/write data in the common RAM 11 via the common bus interface unit 10A, and also to read/write data in the transmission interface unit 5.

Since, an internal arrangement of the second controlling microcomputer 200 is similar to that of the first controlling microcomputer 100, no further explanation thereof is made in the following description. The first and second controlling microcomputers 100 and 200 can communicate the data therebetween by reading/writing the data into the common RAM 11 provided on the common bus 3.

As shown in FIG. 3, the console 4 is equipped with a display unit 16 and a keyboard 17. Both the transmission control changing units 26, 46 and also the monitor units 27 and 47 are actually constructed by way of a software architecture, or computer program. This computer program has been previously stored in ROMs 13A and 13B, which is executed by the respective CPUs 12A and 12B.

Reception of Transmission Control Signal

Figure 4:
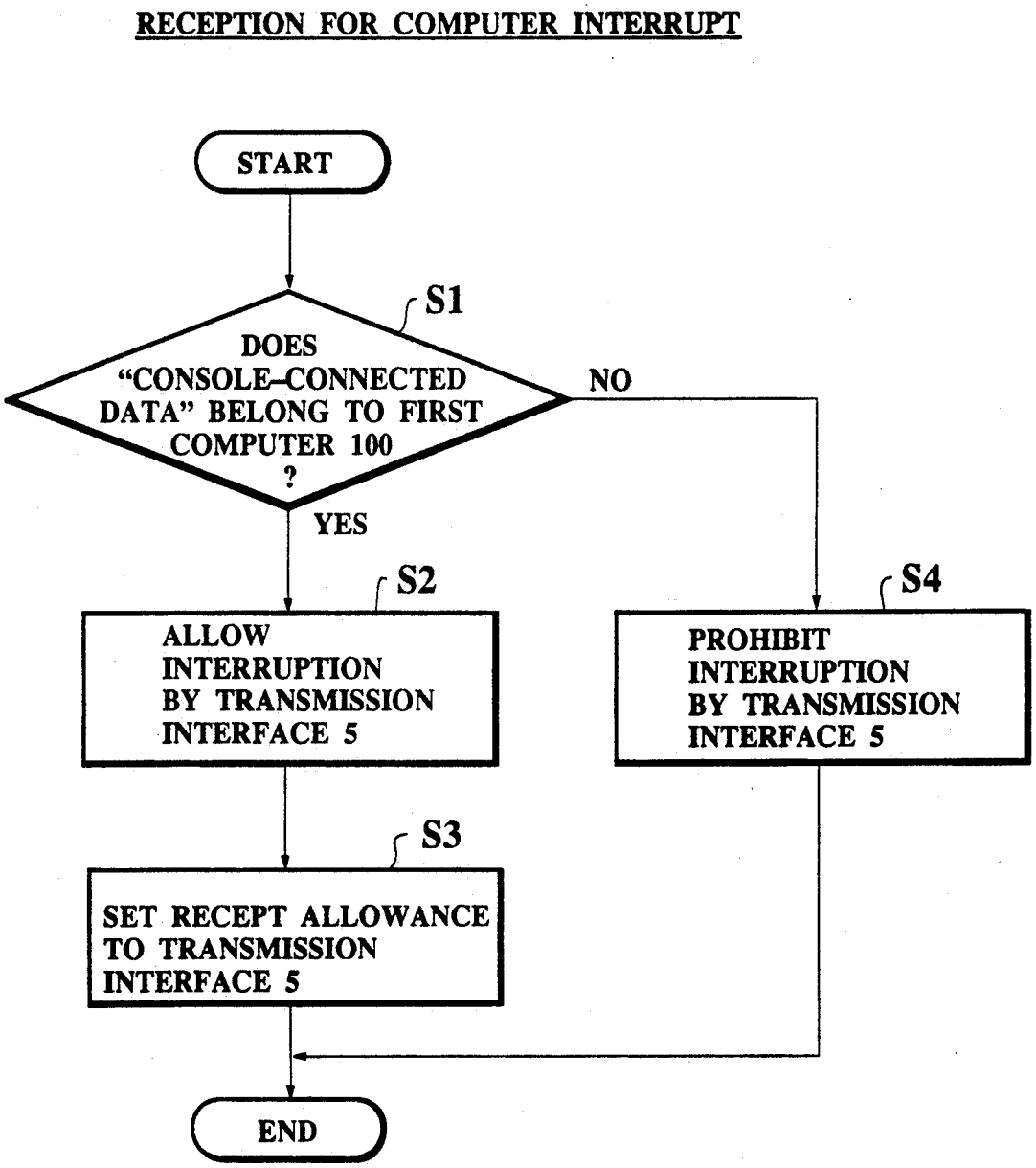
FIGS. 4 to 7 are flow charts for explaining operations of the first elevator controlling system.

Referring now to a flow chart of FIG. 4, a process for determining whether or not the transmission control signal 50 derived from the transmission interface unit 5 is received by either the first controlling microcomputer 100 or the second controlling microcomputer 200.

At a first step S1 of this flow chart, a check is made whether or not so-called "console-connected data" is issued for either the first or second controlling microcomputer 100 or 200. It should be noted that this "console-connected data" is defined based on a certain address of the common RAM 11 provided on the common bus 3, and indicates the controlling microcomputer that transmits/receives the data between the console 4 and this microcomputer. For instance, assuming now that the "console-connected data" is 1 byte, when this data is 0 to 7FH, this data is issued for the first controlling microcomputer 100, whereas when the data is 80H to FFH, this data is issued for the second controlling microcomputer 200. It should also be noted that since either the first or second controlling microcomputer 100 or 200 is necessarily selected for all of the values, it is required to prevent such a phenomenon that the console 4 is connected to nowhere.

When the power is supplied to the first elevator controlling system shown in FIG. 3, assuming now that this "console-connected data" corresponds to "zero", the first controlling microcomputer 100 is designated, namely communicated to the console 4. That is, since the CPU code data indicates the first controlling microcomputer 100 at the step S1, the first controlling microcomputer 100 allows to accept the transmission control signal 50 as the interrupt signal from the transmission interface unit 5 at a step S2, and then sets a receipt allowance to the transmission interface unit 5 at a step S3.

At the previous step S1, the second controlling microcomputer 200 determines that this "console-connected data" does not belong thereto. Then, interruption by the transmission interface unit 5 is prohibited at a step S4.

The subsequent operations of the first and second controlling microcomputers 100 and 200 by operating the keyboard 17 of this console 4 will now be described. First, it is considered that the data is received by the console 4. Since the console 4 is merely operable as a terminal, when the keys mounted on the keyboard 17 are manipulated, the code corresponding to these keys are transmitted from the console 4.

Assuming now that only the first microcomputer 100 has permitted to accept the transmission control signal (transmission interrupt signal) 50 derived from the transmission interface unit 5, although the transmission interrupt process by the first microcomputer 100 is performed in response to the transmission signal from the console 4, the transmission interrupt process is not executed by the second microcomputer 200.

Transmission Interrupt Process

This transmission interrupt process corresponds to a part of functions for the monitor unit 27 or 47 shown in FIG. 2.

Referring now to a flow chart shown in FIG. 5, the transmission interrupt process will be described. In this flow chart, when interruption is required by the transmission interface unit 5, a judgement is made whether or not this interruption request corresponds to a receipt demand at a step S11. This may be judged by reading a status register (not shown in detail) employed in the transfer interface unit 5. Generally speaking, most of the transmission interface ICs used for a general-purpose serial data transmission have such status registers. However, if not, then both the transmission interrupt request and the reception interrupt request which are issued from the transmission interface unit 5 may be supplied into CPU 12A or 12B.

If a judgement result is that the reception request is issued at the step 11, then the reception data of 1 byte is read out from the transmission interface unit 5 at a step 12.

At the next step S13, another judgement is carried out whether or not the reception data corresponds to a specific code. The specific code is predetermined as a code indicative of an end of a command supplied from the console 4 (e.g., ASCII (American Standard Code for Information Interchange) codes of carriage return); a code for interrupting the command; a code for temporarily interrupting the erasing the data which has been previously received (back space) and the like.

In case that the reception data is not equal to the specific code, this reception data is written into a position of a reception buffer (not shown) provided on RAM 14A, which is indicated by a reception pointer (not shown), and the reception pointer is incremented at a step S14.

To the contrary, if the reception data corresponds to the specific code, the process defined by this code is executed at a step 15.

Then, a process to transmit the data to the console 4 will now be explained. This transmission is performed in response to the command received from the console 4, in case that the command required for the response is processed, for instance, the command to read out the contents of the designating address on the memory at a step S16.

Figure 6:
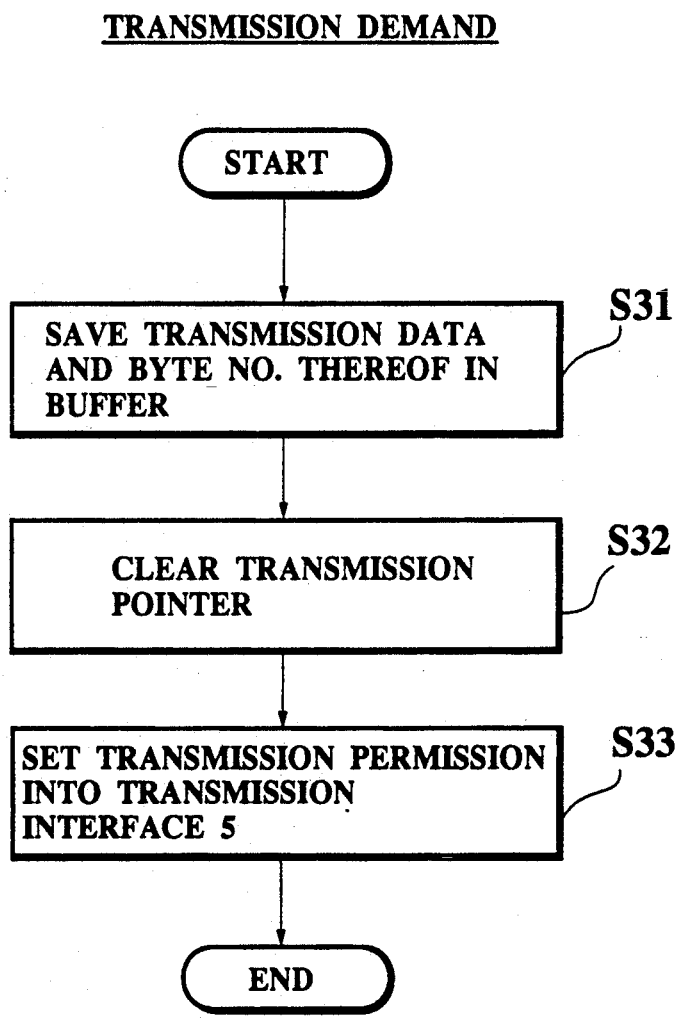

Then, the case where the transmission request is received is given in a flow chart shown in FIG. 6. That is, under such a condition that it is judged to require the monitor unit 27 to return the data in response to the command received from the console 4, both the byte number of the transmission data and the transmission data are saved into a buffer at a step 31. A transmission pointer (not shown) is cleared or initialized to zero at a step S32 and then a transmission permission is made in the transmission interface unit 5 at a step 33.

Figure 5:
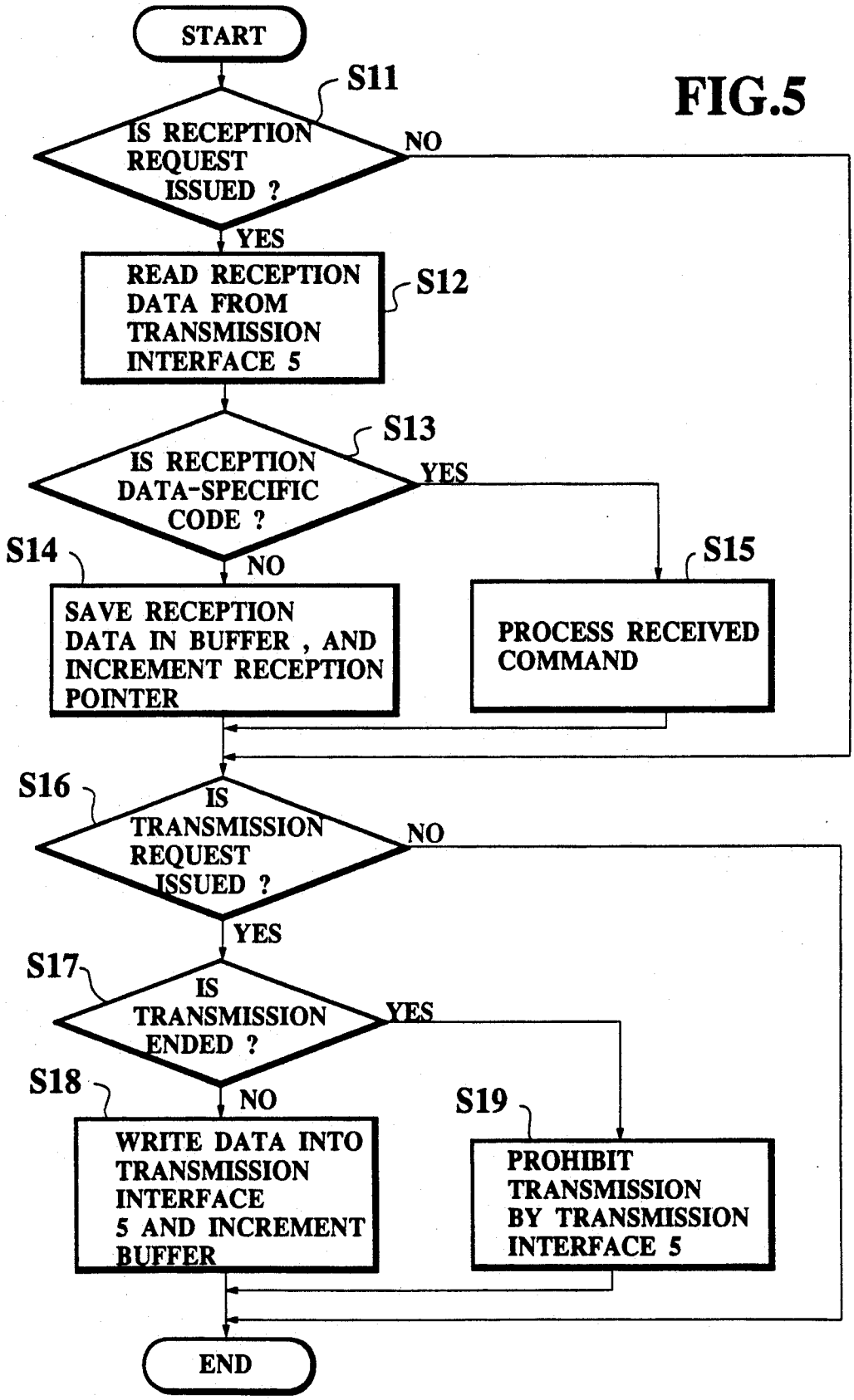

Then, when the transmission interface unit 5 is brought into the transmission permission state and also the transfer buffer of which is empty, the transmission control (interrupt) signal is outputted therefrom to CPU 12A, another judgement is made at a step S16 shown in FIG. 5 whether or not this interruption corresponds to the transmission request. This judgement is performed in a similar way to that of the previous step S11, namely by checking the status register of the transmission interface unit 5.

When a judgement result is made that the transmission demand is issued at this step S16, a further judgement is established whether or not the transmission is ended at the next step 17. It should be noted that when the transmission byte number is equal to the content of the transmission pointer, the transmission is accomplished.

If the transmission is not yet completed, than the transmission data is written into the transmission interface unit 5 at a step S18 and the transmission pointer is incremented. To the contrary, if the transmission is completed at the step 17, then the transmission by the transmission interface unit 5 is prohibited at a step S19.

Subsequently, the data which has been written into the transmission interface unit 5 is converted into serial data, sent to the console 4, and thereafter displayed on the display unit 16 of the console 4.

Reception Data Analysis

The monitor units 27 and 47 own a further function, i.e., analysis of received data, other than the above-described processes with reference to FIGS. 5 and 6.

Figure 7:
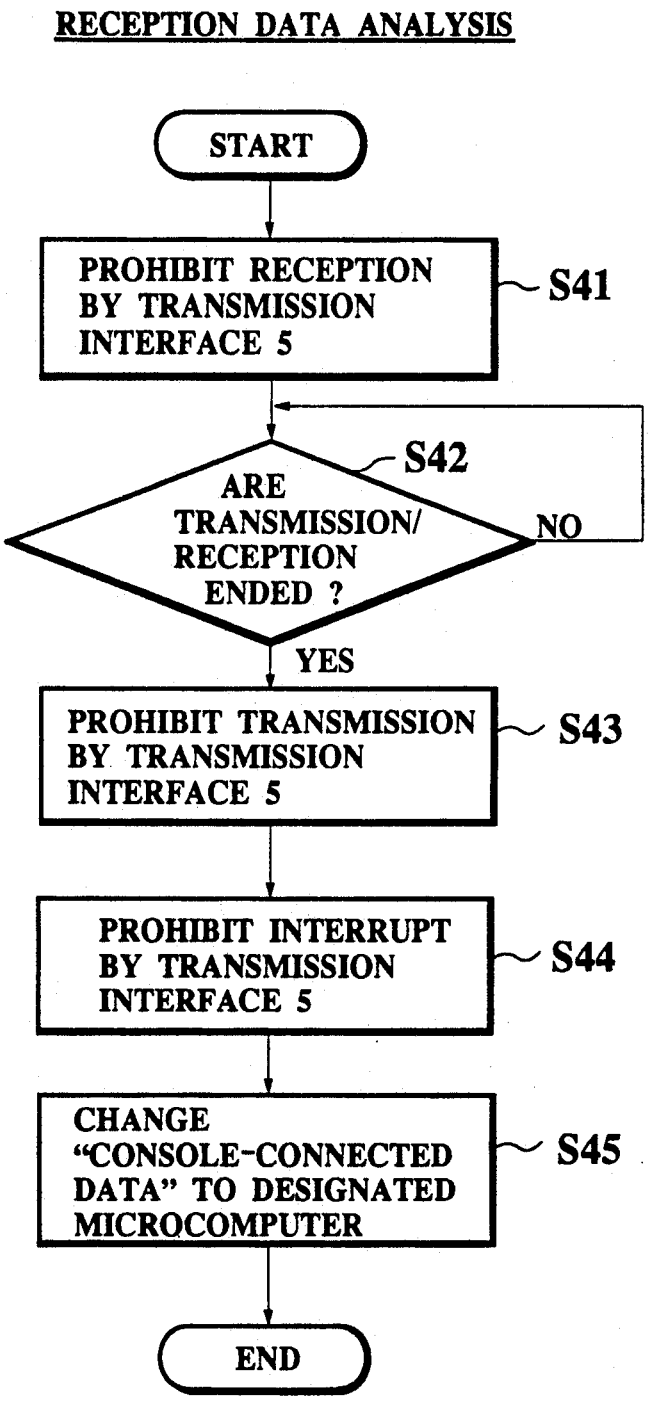

FIG. 7 is a flow chart for explaining such an analysis of the received data that is performed. When, for instance, the operation of the first controlling microcomputer 100 which has so far transmitted/received the data with the console 4, is changed into the second controlling microcomputer 200.

Upon receipt of a command to change connections of the console 4 issued from the console 4, the transmission interface unit 5 is brought into a reception prohibit status at a step S41 so as not to receive the data from the console 4.

Therefore, in case that the transmission operation is under process in response to the command data within has been issued from the console 4, this analysis process waits until all of these processes have been completed at a step S42. After all of the data transmission/reception operations have been accomplished, the transfer interface unit 5 is brought into the transmission prohibit status at a step S43.

As a result, since the data transmission and reception between the console 4 and either the first controlling microcomputer 100 or second controlling microcomputer 200 are once accomplished, the interrupt by the transmission interface unit 5 is prohibited so that the communication with the console 4 is disconnected at a step S44, and subsequently the "console-connected data" stored in the common RAM 11 is changed from the first microcomputer 100 into the second microcomputer 200 designated by the console 4 at a step S45.

Accordingly, the transmission control changing unit 46 of the designated second controlling microcomputer 200 waits for receiving the transmission control signal 60 (interrupt signal) from the console 4 in accordance with process as defined in the flow chart shown in FIG. 4, and then receives the command issued by operating the keyboard 17 of the console 4.

Modifications of First Elevator Controlling System

In accordance with the present invention, various modifications may be made based upon the first basic idea.

For instance, more than three controlling microcomputers may be employed in such a manner that internal arrangements of the additional controlling microcomputers are identical to those of the first and second controlling microcomputers 100 and 200, and the transmission control signal 60 is similarly supplied thereto.

Also, although the data displays on the display unit 16 of the console 4 effected by operating the keyboard 17 thereof were executed by the console 4 per se, the first and second controlling microcomputers 100 and 200 may perform all of the display controls at the display unit 16 of the console 4. In this case, the reception data may be transmitted every time 1-byte data is received from the console 4.

As previously described in detail, according to the first elevator controlling system, since when the maintenance and system adjustments are carried out, only changing the software is required if one controlling microcomputer which has so far processed the command data issued from the console is substituted by other controlling microcomputers, such maintenance and system adjustments become more simpler than those of the conventional system. Since only one transmission changing device is additionally required, the total manufacturing cost of the first elevator controlling system may be reduced.

Second Basic Idea

In accordance with the above-described second basic idea of the present invention, a console of an elevator controlling system can transmit/receive data to/from all of controlling microcomputers via a single transmission interface unit, and a selection switch is provided so as to select to which control microcomputer the console transmits/receives the command data. Accordingly, while maintenance or a system adjustment is performed in one controlling microcomputer, even when data transmission/reception are required for other controlling microcomputer to monitor the conditions of the elevator (not shown) under control by the last-mentioned controlling microcomputer, the selection switch is merely operated, resulting in preventing such a conventional cumbersome work load. Also, even if a total number of controlling microcomputers is increased more and more, since only one transmission interface unit is sufficient, the manufacturing cost of this elevator controlling system can be considerably lowered, as compared with that of the convention elevator controlling system in which the transmission interface units are employed every controlling microcomputers.

Figure 8:
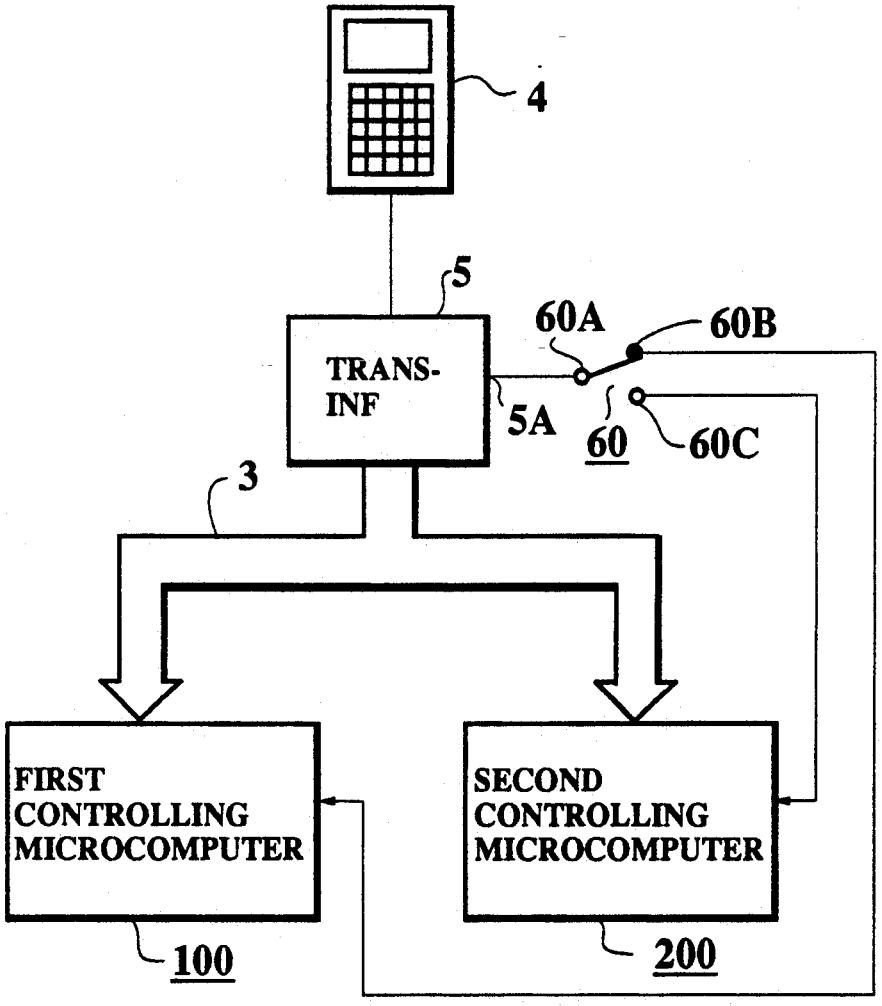
FIG. 8 is a schematic block diagram for showing an elevator controlling system arranged on the basis of a second basic idea of the present invention.

The above-described second basic idea of the present invention may be realized, for interface, by a schematically illustrated elevator controlling system as shown in FIG. 8. In this elevator controlling ststem, both the first controlling microcomputer 100 and the second controlling microcomputer 200 are connected via the common bus 3 to each other. Similarly, both the console 4 and transmission interface unit 5 are provided on this common bus 3. A common terminal 60A of a selection switch 60 is connected to a control signal output terminal 5A of this transmission interface unit 5. One switching terminal 60B of this selection switch 60 is connected to the first controlling microcomputer 100, whereas the other switching terminal 60C thereof is connected to the second controlling microcomputer 200.

It should be understood that the data transmission among the console 4, first controlling microcomputer 100 and second controlling microcomputer 200 must be performed in such a way that a series of data is subdivided by a certain data unit, irrelevant to parallel data and also serial data. In order that the data in one unit is continuously transmitted or received, either a reception demand in one unit (data in one unit has been received from the console 4), or a transmission demand in one unit (data in one unit has been transmitted to the console 4) must be sent to the relevant microcomputer 100 or 200. The selection switch 60 is employed in a transmission control signal path. When one switching terminal 60B is closed, the data transmission can be established between the console 4 and the first controlling microcomputer 100. Conversely, when the other switching terminal 60C is closed, the data transmission can be executed between the console 4 and the second controlling microcomputer 200.

Internal Arrangement of Second Elevator Controlling System

Figure 9:
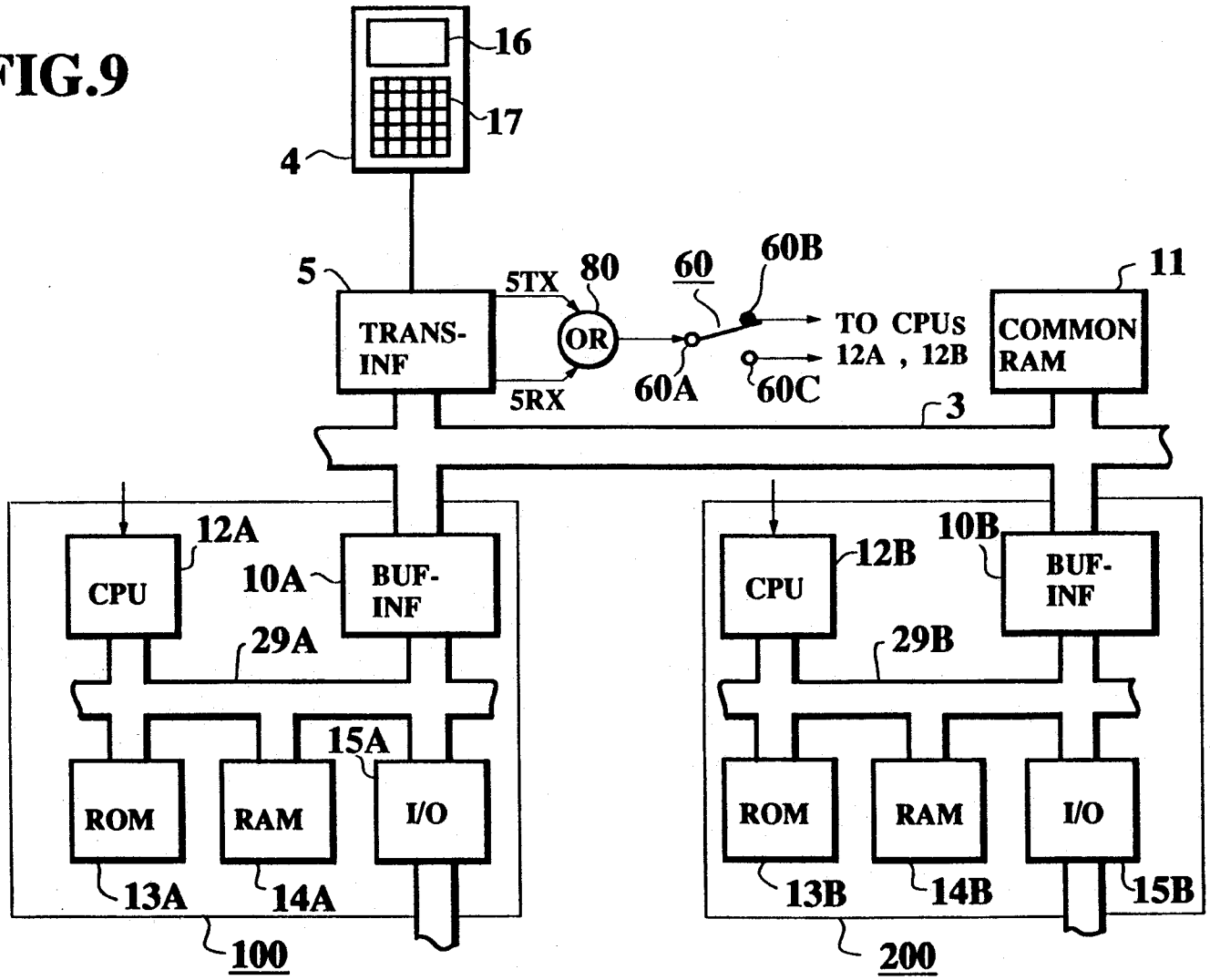
FIG. 9 is a schematic block diagram for representing an internal arrangement of the second system shown in FIG. 8; and, FIG. 10 schematically shows memory arrangements of RAM employed in the first and second systems.

In FIG. 9, there is shown an internal arrangement of an elevator controlling system according to a second preferred embodiment of the present invention, which is realized based on the second basic idea. As apparent from this drawing, since most of the second elevator controlling system is the same as that of the first elevator controlling system shown in FIG. 3, only different circuit arrangement thereof will now be explained. That is, a transmission demand signal terminal 5TX of the transmission interface unit 5 and also a reception demand signal terminal 5RX thereof are connected via an OR gate 80 to the common terminal 60A of the selection switch 60. As previously described, one switching terminal 60B of this selection switch 60 is connected to the first CPU 12A employed in the first controlling microcomputer 100, whereas the other switching terminal 60C thereof is connected to the second CPU 12B employed in the second controlling microcomputer 200.

Overall Operation of Second Elevator Controlling System

It is now considerated that a demand is issued to receive data from the console 4. In this case, since the console 4 is merely operable as a "terminal", when the keys mounted on the keyboard 17 of this console 4 are operated, the console 4 transmits codes corresponding to the operated keys. Both the first and second controlling microcomputers 100 and 200 are kept under receptable conditions in order that anytime the keyboard 15 of the console 4 may be manipulated. Assuming now that the first switching terminal 60B is closed, the transmission interface unit 5 enables the first CPU 12A employed in the first controlling microcomputer 100 to be interrupted every time 1-byte signal is inputted therein from the console 4. As a result, an interrupt process which has been previously stored as program data in first ROM 13A is executed.

It should be noted that since this interrupt process by the second elevator controlling system is similar to that by the first elevator controlling system shown in FIGS. 4 to 7, no further detailed description thereof is made in the following description. In other words, the flow chart for explaining the interrupt operation by the first elevator controlling system may be commonly used to explain the interrupt operation by the second elevator controlling system.

Memory Arrangement of RAM

In connection with the transmission demand process as shown in FIG. 6, a memory arrangement of RAM 14A or 14B will now be described more in detail with reference to FIG. 10.

Figure 10:
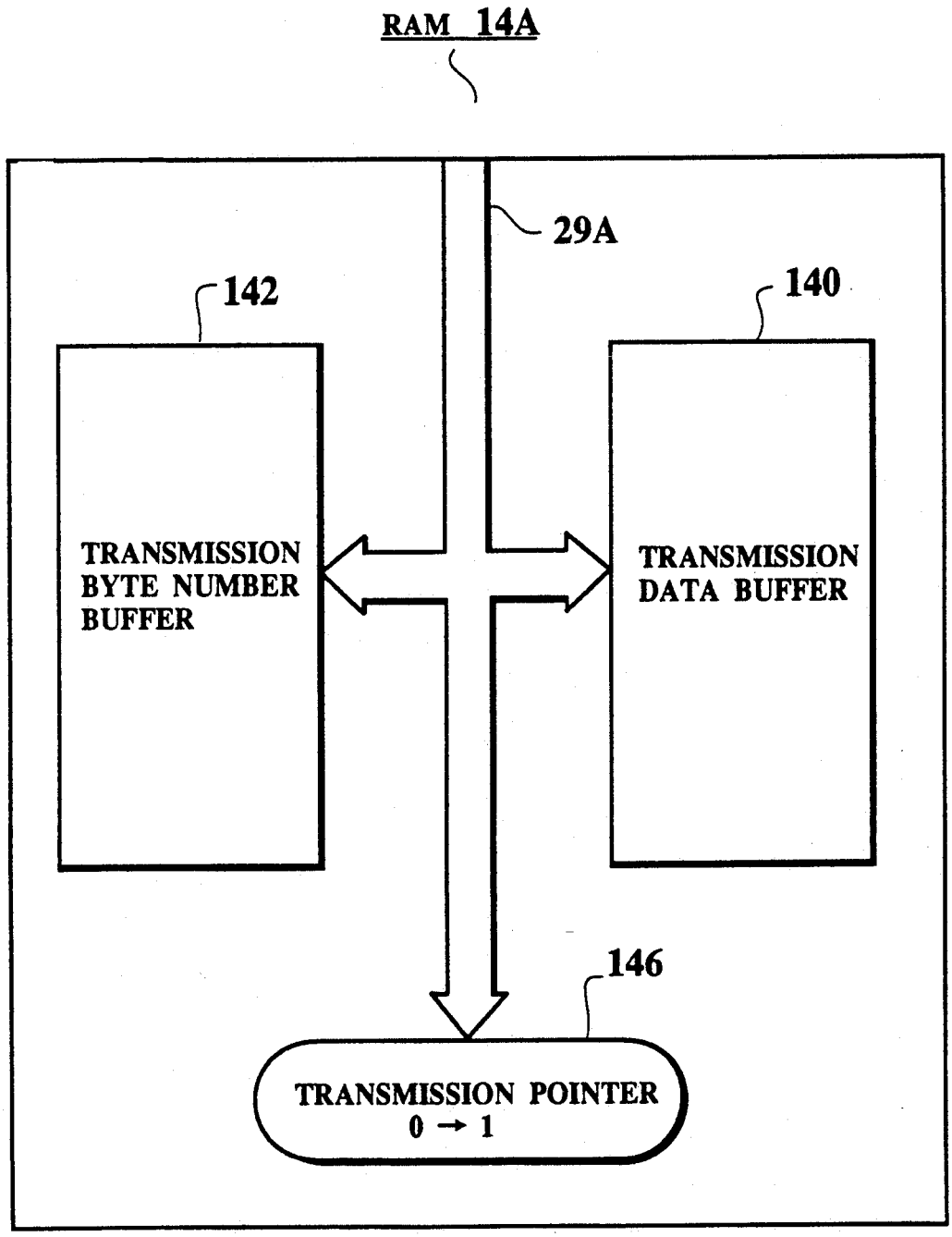

The first RAM 14A shown in FIG. 10 is mainly arranged by connecting a transmission data duffer 140, a transmission byte number buffer 142 and a transmission pointer 146 with each other via the local bus 29A.

Referring again to the flow chart shown in FIG. 6, the transmission demand process executed in the second elevator controlling system will now be described.

As represented in the flow chart of FIG. 6, after both the transmission data and the byte number of this data are saved in the transmission data buffer 140 and transmission byte number buffer 142, respectively, at the step S31, the content of the transmission pointer 146 is cleared (becomes zero) at the next step S32. Thereafter, the transmission permission is set in the transmission interface unit 5 at the step S33.

Then, when the transmission interface unit 5 is brought into the transmission permission state and also the transmission duffer of which is empty, the transmission control (interrupt) signal is outputted to the first CPU 12A.

Then a judgement is made whether or not, this interrupt signal corresponds to the transmission demand at the step 16 shown in FIG. 5. This judgement is performed in a similar way to that of the previous step S11, namely by checking the status register of the transmitted interface unit 5.

When a judgement result is made that the transmission demand is issued at this step S16, a further judgement is established whether or not the transmission is ended at the next step 17. It should be noted that when the transmission byte number is equal to the content of the transmission pointer 146, the transmission is accomplished.

If the transmission is not yet completed, then the transmission data is written into the transmission interface unit 5 at a step S18 and the transmission pointer 146 is incremented. To the contrary, if the transmission is completed at the step 17, then the transmission by the transmission interface unit 5 is prohibited at a step S19.

Subsequently, the data which has been written into the transmission interface unit 5 is converted into serial data, sent to the console 4, and thereafter displayed on the display unit 16 of the console 4.

When the second switching terminal 60C of the selection switch 60 is closed, data transmission/reception are performed between the console 4 and the second controlling microcomputer 200 in a similar manner to that of the first controlling microcomputer 100.

As previously described in detail, in case that the data are being transmitted/received between one controlling microcomputer and the console while observing the control conditions of the elevator controlled by the first-mentioned controlling microcomputer, even when the data transmission/reception between the other controlling microcomputer and the console are required, this operation can be realized by merely changing the selection switch.

Since other particular advantages and modifications of the second elevator controlling system are the same as those of the first elevator controlling system, no further explanation thereof is made.

What is claimed is:

1. An elevator controlling system comprising:

a plurality of controlling microcomputers for controlling a plurality of elevators corresponding thereto;

single console means for inputting at least command data to instruct establishment of data communication, and also for monitoring conditions of the elevators under control;

single data transmission interface means, one terminal of which is connected to the console means and the other terminal of which is commonly connected to said plurality of controlling microcomputers; and, a plurality of transmission control changing means employed in said plurality of controlling microcomputers, for changing data communication established in the console means and the respective controlling microcomputers in response to the command data inputted by the console means such that while said console means is being connected with one of said plurality of controlling microcomputers via said data transmission interface means to establish one data communication between said console means and said one controlling microcomputer, another data communication is established between said console means and another one of said controlling microcomputers by inputting said command data from said console means into said another one of said controlling microcomputers to monitor the condition of the elevator controlled by said another one microcomputer.

2. An elevator controlling system as claimed in claim 1, wherein said transmission control changing means are built within the corresponding microcomputers.

3. An elevator controlling system as claimed in claim 1, wherein said console means includes:

a keyboard for entering the command data; and, a display unit for displaying the conditions of the selected controlling microcomputer.

4. An elevator controlling system as claimed in claim 3, wherein said console means is detachably connected to the elevator controlling system.

5. An elevator controlling system as claimed in claim 1, wherein each of said controlling microcomputers includes at least:

a central processing unit into which the command data is supplied from said data transmission interface means; and also, a read-only memory for previously storing therein a system program.

6. An elevator controlling system comprising:

a plurality of controlling microcomputers for controlling a plurality of elevators corresponding thereto;

single console means for inputting at least command data to instruct establishment of data communication and for monitoring conditions of the elevators under control;

single data transmission interface means, one terminal of which is connected to the console means and the other terminal of which is commonly connected to said plurality of controlling microcomputers; and, command data selecting means including a switch having a common terminal connected to the single data transmission interface means and switching terminals connected to said plural microcomputers, for selecting one of said plural microcomputers which receives the command data derived from the console means via the transmission interface means such that while the console means is being connected with one controlling microcomputer via said data transmission interface means to establish one data communication between said console means and said one controlling microcomputer, another data communication is established between said console means and another one of said controlling microcomputers by inputting said command data from said console means into said another one controlling microcomputer to monitor the condition of the elevator controlled by said another one microcomputer.

7. An elevator controlling system as claimed in claim 6, wherein said console means includes:

a keyboard for entering the command data; and, a display unit for displaying the conditions of the selected controlling microcomputer.

8. An elevator controlling system as claimed in claim 7, wherein said console means is detachably connected to the elevator controlling system.

9. An elevator controlling system as claimed in claim 6, wherein each of said controlling microcomputers includes at least:

a central processing unit into which the command data is supplied from said data transmission interface means; and also, a read-only memory for previously storing therein a system program.

* * * * *